United States Patent [19]

Berfield

[11] 4,413,372

[45] Nov. 8, 1983

[54] SHOE ATTACHMENT FOR WET/DRY ELECTRIC VACUUM CLEANER

[75] Inventor: Robert C. Berfield, Jersey Shore, Pa.

[73] Assignee: Shop-Vac Corporation, Williamsport, Pa.

[21] Appl. No.: 320,721

[22] Filed: Nov. 12, 1981

[51] Int. Cl.[3] ..... A47L 9/02

[52] U.S. Cl. ..... 15/414; 15/353; 15/401; 15/415 R

[58] Field of Search ..... 15/320, 321, 322, 401, 15/414, 415 R

[56] References Cited

U.S. PATENT DOCUMENTS

| | | | |
|---|---|---|---|
| 2,349,371 | 5/1944 | Patterson | 15/401 |
| 3,871,051 | 3/1975 | Collier | 15/321 |
| 3,958,298 | 5/1976 | Cannan | 15/322 |
| 4,095,309 | 6/1978 | Sundheim | 15/321 X |
| 4,334,337 | 6/1982 | Miller et al. | 15/353 X |

*Primary Examiner*—Chris K. Moore

*Attorney, Agent, or Firm*—Ostrolenk, Faber, Gerb & Soffen

[57] ABSTRACT

The disclosure concerns a shoe attachment for insertion in the intake orifice of an electric vacuum cleaner that includes a housing having an intake orifice at the underside thereof. Wheels support the housing and raise the intake orifice off the surface to be cleaned. The shoe attachment is detachably fitted in the intake orifice. The shoe attachment has an undersurface that rides along the surface to be vacuum cleaned. A narrowed width inlet opening through the shoe attachment increases the intake air speed and/or the suction force, facilitating picking up of heavy material and liquid. The shoe attachment is flexible and resilient to conform to irregularities in the surface being vacuum cleaned.

12 Claims, 6 Drawing Figures

SHOE ATTACHMENT FOR WET/DRY ELECTRIC VACUUM CLEANER

BACKGROUND OF THE INVENTION

The invention concerns a wet/dry vacuum cleaner and in particular a shoe attachment for the intake of a vacuum cleaner which is suitable for picking up dry materials, wet materials and even liquids. The invention is particularly useful for the intake of an electric vacuum cleaner, such as that shown in U.S. application Ser. No. 134,776 filed Mar. 28, 1980, entitled "COMPACT WET-DRY ELECTRIC VACUUM CLEANER", and assigned to the assignee hereof now U.S. Pat. No. 4,334,337, issued June 15, 1982.

An electric vacuum cleaner generally includes suction generating apparatus, such as a suction fan, which communicates with an intake orifice. To increase suction force at the intake orifice, the orifice is typically of reduced width across at least one dimension and the reduced size of the orifice increases the speed of air flow through the orifice.

An electric vacuum cleaner may be of the type where the intake is at the front or the underside of a housing that rides along the surface to be suctioned cleaned, or it may be of the type having an inlet hose with the intake orifice in the nozzle at the end of the hose. The present invention is particularly useful in conjunction with the first type of vacuum cleaner, although it is useful with any type of vacuum cleaner nozzle.

Furthermore, some vacuum cleaners are known as wet/dry types, in that they are adapted to suck in dry particulate materials, wet or damp materials and even liquids. The vacuum cleaner of the above-mentioned patent application is just such a vacuum cleaner. Dry particulate materials are lighter in weight and thus can be sucked in using a smaller suction force. But wet materials and liquids in particular require a relatively greater suction force to be sucked in. In some circumstances, a vacuum cleaner with an intake suction force only great enough to take in dry particulate materials may not have adequate suction force for taking in wet particulate materials or liquids.

SUMMARY OF THE INVENTION

Accordingly, it is the primary object of the present invention to provide adequate suction force at the intake of a vacuum cleaner.

It is another object of the present invention to enable an electric vacuum cleaner to effectively suck in wet material or liquid.

It is yet another object of the invention to selectively increase the speed of air flow and/or the suction force at the intake of the vacuum cleaner.

It is a further object of the invention to accomplish the foregoing objects with an electric vacuum cleaner of the type wherein the intake orifice rides over the surface to be suction cleaned.

The present invention is described in connection with an electric vacuum cleaner having an intake orifice at the underside of the vacuum cleaner housing which orifice rides above the surface to be suction cleaned. Such a vacuum cleaner normally has an intake orifice which is relatively wide, side-to-side, with respect to the forward and backward directions of the normal pathway of movement of the vacuum cleaner and which is relatively narrow in the front to back dimension along the path of movement of the vacuum cleaner during use. The relatively wide side-to-side but narrow front to back orifice is narrow enough to produce an adequate air flow speed and/or suction force at the intake orifice for at least picking up dry materials.

According to the present invention, a shoe attachment, having an inlet opening adapted for easing the pickup of wet materials in general and liquid in particular, is removably emplaced or inserted in the intake orifice of the vacuum cleaner. The shoe attachment is attachable to and detachable from the vacuum cleaner at the inlet orifice by appropriate attachment means. The shoe attachment extends down to the surface to be suctioned and the shoe attachment includes a bottom surface that rides on the surface to be suction cleaned.

The shoe attachment surrounds the entire intake orifice and has an inlet opening through it, thereby defining a new smaller cross-section inlet opening for the vacuum cleaner. The inlet opening through the shoe attachment has a side-to-side width that is generally the width of the intake orifice of the vacuum cleaner. But, the inlet opening is generally narrower in the front to back dimension than the intake orifice. This increases the speed of air flow and/or the suction force at the inlet opening through the shoe attachment. The increased air flow and/or suction force aids in sucking in liquids from the surface being suction cleaned.

The shoe attachment, at least at the part thereof which is intended to contact the surface to be suction cleaned, is comprised of a flexible plastic resin material, which inherently tends to conform to slight irregularities of the surface from which the material is to be suction cleaned, so that the an effective seal might be obtained with the surface being suctioned and better liquid suction is thereby obtained.

Other objects and features of the present invention will become apparent from the following description of a preferred embodiment of the invention taken in conjunction with the accompanying drawings.

BRIEF DESCRIPTION OF THE DRAWING FIGURES

FIG. 6 is an enlarged view of the front of the vacuum cleaner housing in FIG. 1 showing the shoe attachment in place.

DESCRIPTION OF A PREFERRED EMBODIMENT

Figure 1:
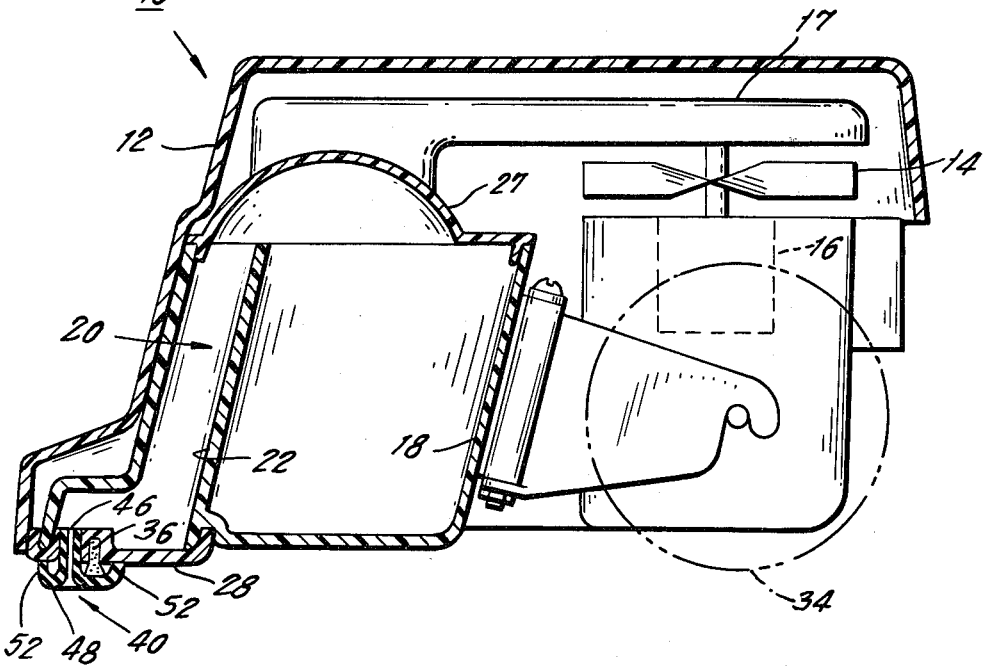
FIG. 1 is a somewhat schematic, side, partially cross-sectional view of the main housing of an electric vacuum cleaner which is provided with the shoe attachment according to the present invention.
Figure 2:
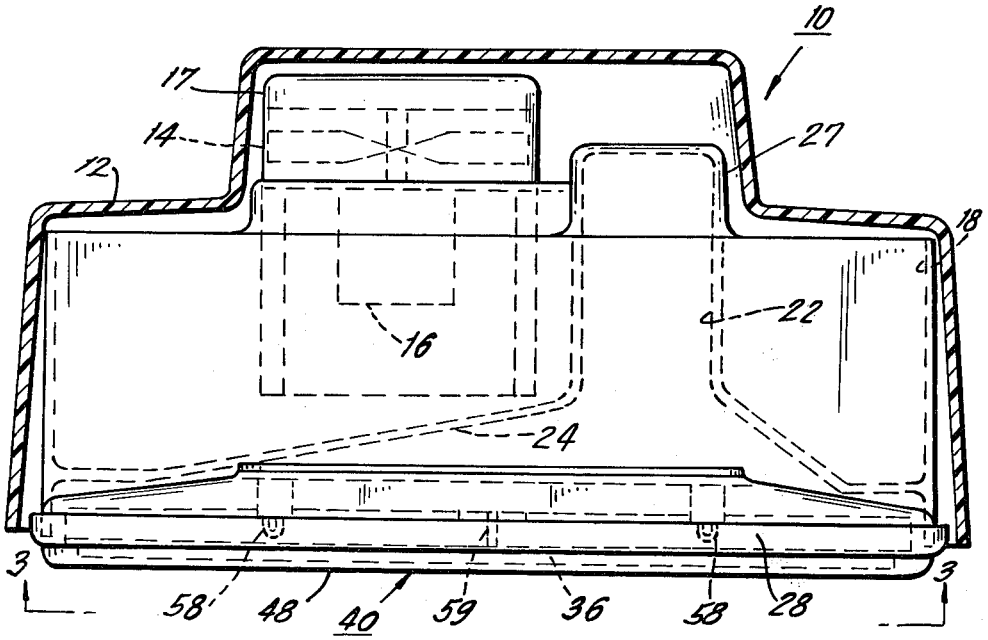
FIG. 2 is a front view, from the left in FIG. 1, of the electric vacuum cleaner housing.

Referring to the drawings, the electric vacuum cleaner 10 is a suction cleaner of the type shown in U.S. application Ser. No. 134,776, filed Mar. 28, 1980, entitled "COMPACT WET-DRY ELECTRIC VACUUM CLEANER", assigned to the assignee hereof, and incorporated herein by reference. For understanding the present invention, however, the details of such a vacuum cleaner are not required and an electric vacuum cleaner of the type with which the invention may be used may be an otherwise standard vacuum cleaner known to one skilled in the art.

The electric vacuum cleaner 10 includes an exterior housing 12. A suction fan 14 located within the housing is driven by a motor 16 to rotate. Fan rotation generates a suction force that communicates through the conduit means 17 into the collection tank 18 for the material to be sucked in. The intake 20 to the tank is at reduced pressure due to the pressure reduction in tank 18. The intake 20 comprises the upstanding passageway 22 which leads from the tapering nozzle 24 to which the intake orifice 26 communicates. The inrushing air, particulate material and/or liquid sucked through the passageway 22 strikes the flow redirector 27 and drops into the tank 18.

Figure 3:
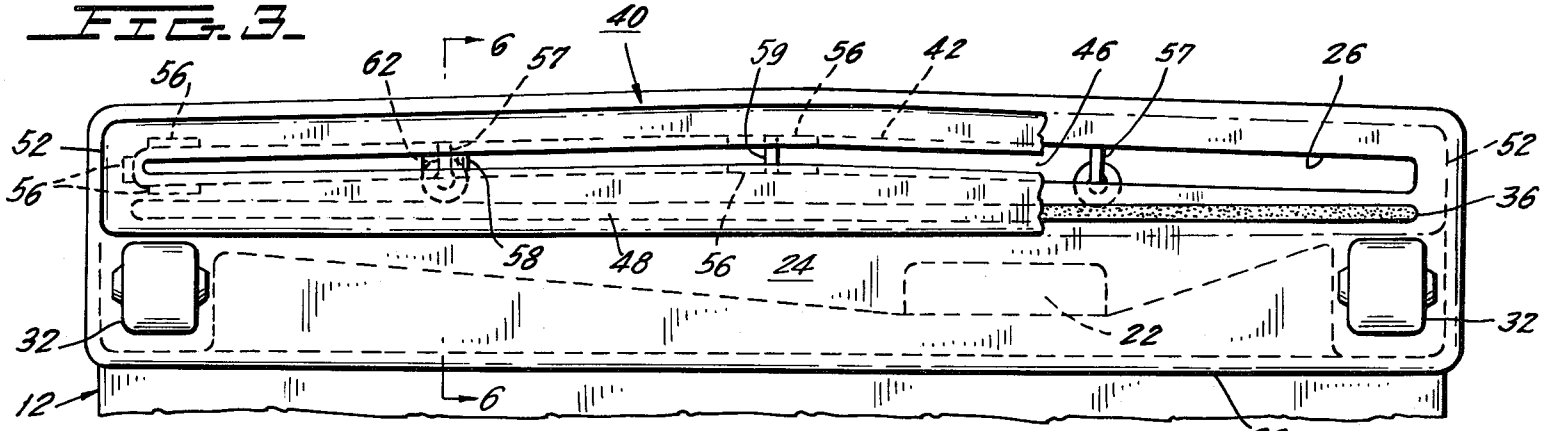
FIG. 3 is a bottom view of a fragment at the front of the housing of the electric vacuum cleaner showing the shoe attachment partially broken away.
Figure 4:
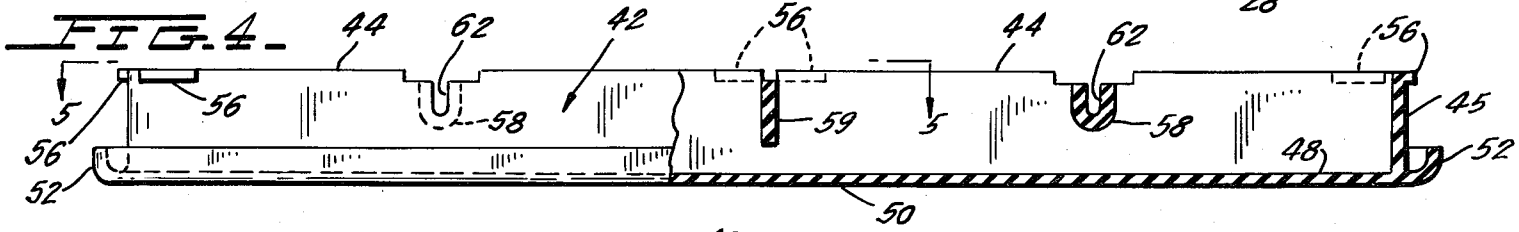
FIG. 4 is a side elevational view, partially in cross section, of the shoe attachment.
Figure 5:
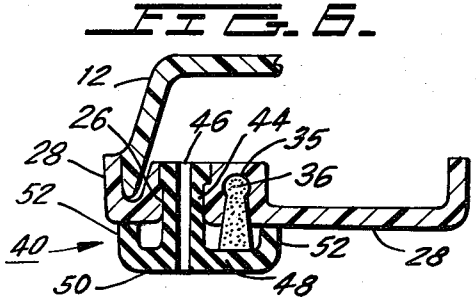
FIG. 5 is a top plan view of a fragment of the shoe attachment of FIG. 4 in the direction of arrows 5.
Figure 5:
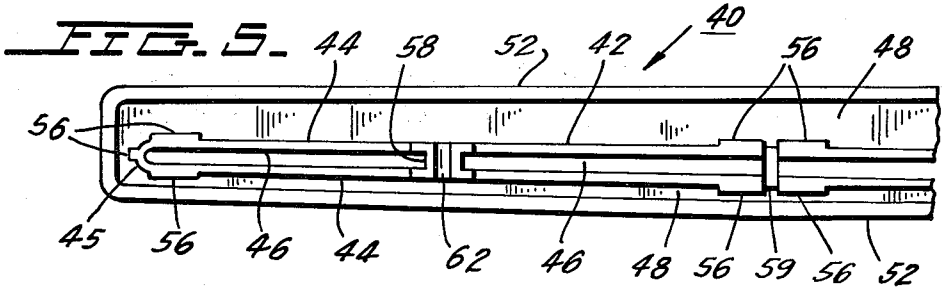

The underside of the housing 12 in the vicinity of the intake orifice 26 is closed. There is a bottom plate 28 of the housing which surrounds and defines the inlet orifice 26. As is apparent from FIG. 3, the inlet orifice 26 is quite wide, extending nearly the full width of the housing 12, 28. At the same time, the front to back dimension (up and down in FIG. 3) of the orifice 26 is relatively short. The thereby narrowed inlet orifice 26 produces adequate airflow and/or suction force for assuring suction cleaning of a surface.

At the ends of the bottom plate 28, conventional roller wheels 32 are supported. In conjunction with the rear wheels 34, the wheels 32 support the housing 12 for movement forward and rearward over the surface to be suction cleaned. The wheels 32, 34 also space the housing base plate 28 a desired distance off the surface to be suction cleaned. In this vacuum cleaner, just to the rear of the intake orifice 26, an opening 35 is defined in the base plate 28 in which a brush or strip 36 of appropriate material is positioned. The strip 36 extends across the width of the orifice 26. The strip serves as means for conventionally guiding particulate material or liquid to the orifice where it can be suctioned.

For increasing the rate of air flow and/or the suction force at the intake orifice 26, the shoe attachment 40 of the present invention is provided.

The shoe attachment 40 is comprised of a single piece of plastic and particularly a thermoplastic elastomer. One example of such an elastomer is Uniroyal TPR-1700R. This resin has the characteristic that it is resilient, in that it tends to restore itself to its original shape if deformed, and it is sufficiently flexible and deformable that it will tend to conform to slight irregularities in the surface over which the shoe attachment is moved during movement of the vacuum cleaner.

The inherent flexibility of the shoe attachment 40 permits it to be removably inserted into the intake of the vacuum cleaner housing.

The shoe attachment 40 comprises an upstanding insertion portion 42 comprised of opposite, spaced apart elongate walls 44 which are joined by end walls 45, and the walls 44 together define a narrowed inlet opening 46 between their opposed interior surfaces. The upstanding walls 44 are shaped so as to snugly fit into the intake orifice 26. The distance between the exterior surfaces of the walls 44 assures their snug sealing fit in the orifice 26. The end walls 45, sealingly engage the corresponding ends of the intake orifice 26. The thickness of the walls 44 is selected so that the resulting opening 46 has the desired front to back width dimension for producing a selected air flow rate and/or suction force at the opening 46. The shoe attachment includes the horizontal base plate 48 which extends both forwardly and rearwardly of the upstanding walls 44. The base plate 48 provides the flat undersurface 50 that rides over and contacts the surface to be suction cleaned. Thus, the undersurface 50 is flat and would be generally horizontal as the vacuum cleaner is moved. The plate 48 is sized, inter alia, to cover up the usual pusher strip 36 as the plate replaces that strip. The plate 48 terminates in the peripheral upstanding lip 52, which engages the underside of the plate 28 of the vacuum cleaner housing. The lip 52 has a height selected so that with the wheels 32 and 34 supporting the vacuum cleaner housing for movement, the undersurface 50 of the plate 48 of the shoe attachment will be at the surface to be suction cleaned.

The walls 44 of the shoe attachment 40 are adapted for firm, but removable attachment in the inlet orifice 26 of the vacuum cleaner. Accordingly, at the upper ends of the walls 44, there are snap-lock tabs 56 at various locations around the shoe attachment, and they are adapted to lock into the orifice 26. Also, there are support struts 57 extending across the intake orifice 26. At locations along the walls 44 of the shoe attachment corresponding to the locations of the struts 56 across the intake orifice 26, the upstanding walls 44 have their own supports comprised of a connector 58, which spans the open space 46 between the walls 44 and defines the recess 62 for receiving the respective strut 56 therein.

As the undersurface 50 of the shoe attachment glides across the surface from which material is to be suctioned cleaned, and particularly if liquid is to be sucked in, the liquid moves beneath the plate 48 and is sucked into the narrowed inlet opening 46, and thereafter travels into the storage tank 18.

With the shoe attachment of the invention installed, the narrowed inlet opening increases the suction force and enables heavy particulate material, e.g. wet particulate materials, and even liquids to be readily sucked into the vacuum cleaner. With the shoe attachment removed, there is weaker suction force to pick up dry particulate materials and there may be adequate suction for picking up other materials, as well.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A shoe attachment for the intake of a suction device, like a vacuum cleaner, or the like, wherein the suction device includes an intake conduit, means for supplying suction force to the intake conduit, and the intake conduit having an end having an intake orifice into which material is sucked by the suction force; means communicating with the intake conduit for receiving material sucked into the intake orifice; the intake conduit being shaped for defining the intake orifice as a relatively narrow opening measured along one dimension of the intake orifice;

the shoe attachment for the intake comprising upstanding walls extending into the intake orifice, a plate extending beneath the end of the intake conduit at which the intake orifice is defined, the walls standing up from the plate, whereby the walls and the plate together close off flow through the intake orifice;

an inlet opening through the plate and defined by and extending between the walls of the shoe attachment and communicating into the intake conduit, wherein the inlet opening is narrower along the same one dimension than the intake orifice for increasing the air speed and/or the suction force at the inlet opening, as compared with the air speed and/or suction force that would be present at the intake orifice were the shoe attachment absent;

the shoe attachment is, at least at the plate thereof, comprised of a flexible and resilient material that is thick and flexible enough to deform to conform to irregularities in the surface over which the plate is moved as the intake conduit and inlet opening are moved across the surface to be suctioned.

2. The shoe attachment of claim 1, wherein the shoe attachment and the plate thereof extend around the periphery of the intake orifice of the suction device.

3. The shoe attachment of claim 1, wherein the shoe attachment is detachably attachable to the intake conduit at the intake orifice.

4. The shoe attachment of claim 3, wherein for the detachable attachment thereof, the shoe attachment further comprising attachment means defined on the shoe attachment for grasping the intake conduit upon insertion of the shoe attachment into the intake conduit.

5. A vacuum cleaner comprising:

a housing, and the shoe attachment of claim 3, the intake conduit being defined in the housing, the means for supplying suction force to the intake conduit being in the housing, and the means communicating with the intake conduit for receiving material sucked through the intake conduit being supported in the housing.

6. The vacuum cleaner of claim 5, further comprising a housing support beneath the housing for supporting the housing on the surface to be vacuum cleaned;

the plate of the shoe attachment being positioned beneath the vacuum cleaner housing so that the inlet opening at the plate is disposed at the surface to be vacuum cleaned and so that the lower surface of the plate contacts the surface to be vacuum cleaned.

7. The vacuum cleaner of claim 6, wherein the housing support comprises rolling wheels for movably supporting the housing and the wheels being positioned for cooperating with the plate of the shoe attachment to maintain the housing at a predetermined orientation on and with respect to the surface to be vacuum cleaned.

8. The vacuum cleaner of claim 7, wherein the intake orifice is oriented so that its narrow dimension is along the normal path of movement of the vacuum cleaner during use of the vacuum cleaner.

9. The vacuum cleaner of claim 5, wherein the intake orifice is oriented so that its narrow dimension is along the normal path of movement of the vacuum cleaner during use of the vacuum cleaner.

10. A vacuum cleaner comprising:

a housing and the shoe attachment of claim 1, the intake conduit being defined in the housing, the means for supplying suction force to the intake conduit being in the housing, and the means communicating with the intake conduit for receiving material sucked through the intake conduit being supported in the housing.

11. The vacuum cleaner of claim 10, wherein the intake orifice is oriented so that its narrow dimension is along the normal path of movement of the vacuum cleaner during use of the vacuum cleaner.

12. The vacuum cleaner of claim 10, further comprising a housing support beneath the housing for supporting the housing on the surface to be vacuum cleaned;

the plate of the shoe attachment being positioned beneath the vacuum cleaner housing so that the inlet opening at the plate is disposed at the surface to be vacuum cleaned and so that the lower surface of the plate contacts the surface to be vacuum cleaned.

* * * * *